US005153401A

United States Patent [19]

Tseng

[11] Patent Number: 5,153,401

[45] Date of Patent: Oct. 6, 1992

[54] SLIDING BLOCK ELECTRICAL SWITCH

[76] Inventor: Tien-Fu Tseng, No. 2, Lane 602, Chung Cheng Rd., Wu Feng Hsiang, Taichung Hsien, Taiwan

[21] Appl. No.: 772,959

[22] Filed: Oct. 8, 1991

[51] Int. Cl.[5] ..... H01H 15/00

[52] U.S. Cl. ..... 200/550; 200/531; 200/275; 200/303; 200/16.00 D

[58] Field of Search ..... 200/16 R, 16 A, 16 D, 200/16 C, 303, 547, 549, 530, 531, 275, 550

[56] References Cited

U.S. PATENT DOCUMENTS

| | | | |
|---|---|---|---|
| 3,694,590 | 9/1972 | Otterlei | 200/16 C |
| 4,001,526 | 1/1977 | Olson | 200/16 D |
| 4,258,237 | 3/1981 | Beck | 200/16 CX |
| 4,293,753 | 10/1981 | Kanada | 200/315 |
| 4,311,885 | 1/1982 | Arthur | 200/16 C |
| 4,764,745 | 8/1988 | Aoi et al. | 200/16 CX |
| 4,825,020 | 4/1989 | Rao et al. | 200/16 D |

FOREIGN PATENT DOCUMENTS

| | | | |
|---|---|---|---|
| 2458400 | 6/1976 | Fed. Rep. of Germany | 200/16 C |
| 47-31553 | 8/1972 | Japan | 200/16 D |

*Primary Examiner*—Ernest G. Cusick
*Attorney, Agent, or Firm*—Bacon & Thomas

[57] ABSTRACT

An electrical switch includes a base, a sliding block, two short circuit metal pieces, contact metal pieces, and a cover. The base is provided at a central portion of the top surface thereof a rectangular slot including therein a sliding block. Located at both sides of the sliding block are short circuit metal pieces. Located at both sides of the rectangular slot are several depressions arranged in a side-by-side manner and connected with the rectangular slot. The depressions include therein the contact metal pieces of triangular construction. The short circuit metal pieces make contact with the contact metal pieces adjacent to each other. The top of the base is provided with a cover. The sliding block is capable of moving in the rectangular slot so as to trigger the short circuit metal pieces to make contact with the contact metal pieces located at different positions in order to carry out the function of circuit switching.

4 Claims, 2 Drawing Sheets

SLIDING BLOCK ELECTRICAL SWITCH

BACKGROUND OF THE INVENTION

The present invention relates to a switching device, and more particularly to a circuit switch, which comprises a base having therein a rectangular slot receiving therein a sliding block. The function of circuit switching is carried out by means of the sliding block which can be actuated to trigger the short circuit metal pieces located by both sides of the sliding block to make contact with two contact metal pieces which are adjacent to each other and are located by both sides of the base.

The circuit switching of the prior art is, in general, done by making use of the connection point and the short circuit metal piece. In other words, the circuit switch of the prior art is defective in design in that the contact piece is fused with the electrical wire by means of welding, and that the apparatus used for moving and contacting the short circuit piece and the contact piece is structurally complicated and is thus vulnerable to a poor contact. In addition, the manufacturing process of a prior art circuit switch involves riveting and welding, which are directly and indirectly responsible for an over-all high cost of production of the circuit switch and the high rate of rejection of the product. It is therefore necessary to find a way to improve the design of circuit switch with a view to simplify the manufacturing process of circuit switch, thereby resulting in saving a substantial amount of production materials and in producing a circuit switch of high quality having a long service life.

SUMMARY OF THE INVENTION

It is therefore the primary objective of the present invention to provide a circuit switch designed to comprise therein fewer structural components, which result in precision switching, easy wiring and eliminatin of welding and riveting.

It is another objective of the present invention to provide a circuit switch designed especially for use in switching the gear of the motor of a ceiling fan.

In keeping with principles of the present invention, the primary objectives of the present invention are accomplished by a circuit switch comprising a base, a sliding block, two short circuit metal pieces, contact metal pieces, and a cover.

The base comprises at the central portion of top surface thereof a rectangular slot. Located by each of two long sides of the rectangular slot are three depressions disposed in such ways that thay are arranged in a side-by-side manner and that the depth of the depressions is greater than that of the rectangular slot. The upper section of the inner side of the depression communicates with the rectangular slot. Two adjacent depressions are partitioned by means of a wall. A guide wire insertion slot is disposed at outer side of the depression. The wall separating the depressions is connected with an outer wall located by one side of the insertion slot. The sliding block is accommodated in the rectangular slot. Each of the long sides of the sliding block is provided at a lower section thereof with a recessed space. The sliding block further comprises at the central portion of the bottom thereof a protruded portion extending slightly outwardly. A clamping block is disposed by the outer side of the long side of the sliding block in such a manner that it is positioned correspondingly to the protruded portion and that there is an approriate clearance bteween the clamping block and the protruded portion. The length of two short circuit metal pieces is about equal to the combined length of two adjacent depressions. Both ends of the short circuit metal piece extend outwardly toward both sides of the sliding block. Each of the two short circuit metal pieces is disposed by the side of the sliding block in such a manner that its inner recessed portion is fastened to the sliding block by means of the protruded portion and the clamping block. The contact metal pieces are lodged in the depressions and are equal in number and height to the depressions. The metal pieces are of triangular construction and their contact surfaces facing the rectangular slot obstruct the common passage shared by both rectangular slot and depression. The support portion of the contact metal piece is kept close to the wall while the fastening portion of the contact metal piece is located at the insertion slot and is bent inwardly toward the rectangular slot. The cover is secured to the top of the base so as to seal the tops of the rectangular slot and depressions.

DETAILED DESCRIPTION OF THE PREFERRED EMBODIMENT

Figure 1:
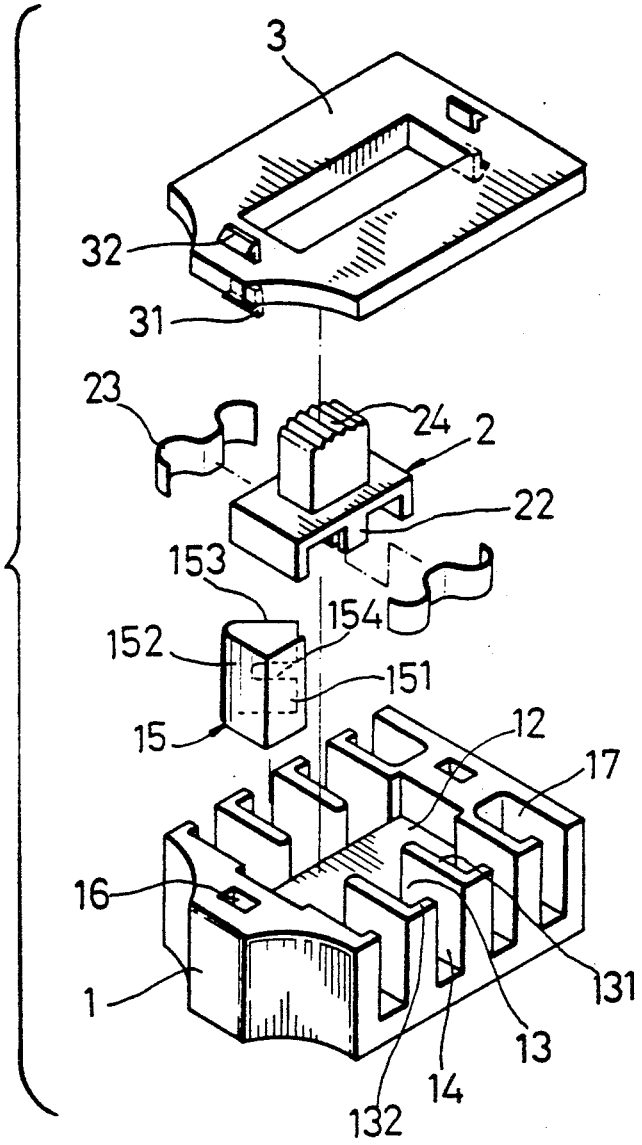
FIG. 1 shows an exploded view of the preferred embodiment of the present invention.

Referring to all drawings provided herein, the preferred embodiment of the present invention is shown comprising a base 1, a sliding block 2, and a cover 3. The base 1 comprises at the central portion of a top surface thereof a rectangular slot 12. Located by each of two long sides of the rectangular slot 12 are three depressions 13 disposed in such ways that they are arranged in a side-by-side manner and that the depth of the depressions 13 is greater than that of the rectangular slot 12. The upper section of the inner side of the depression 13 communicates with the rectangular slot 12. Two adjacent depressions 13 are partitioned by means of a wall 131. An insertion slot 14 of the guide wire 5 is disposed at the outer side of the depression 13. The wall 131 separating the depressions 13 is connected with an outer wall 132 located by one side of the insertion slot 14. Lodged in the depression 13 is a contact metal piece 15, which is equal in height to the depression 13 and is of a triangular construction with the contact surface 151 thereof facing the rectangular slot 12 being arranged in such a manner that it obstructs the common passage shared by both rectangular slot 12 and the depression 13. The support portion 152 of the contact metal piece 15 is kept close to the wall 131 while the fastening portion 153 of the contact metal piece 15 is located at the insertion slot 14 and is bent inwardly toward the rectangular slot 12. The movable end of the contact metal piece 15 is used to clamp the guide wire 5. The fastening portion 153 comprises a cross slit 154 extending horizontally from the movable end to divide the fastening portion 153 into two pieces.

The rectangular slot 12 of the base 1 comprises therein a sliding block 2. Each of the two long sides of the rectangular slot 12 is provided with a recessed space located at the lower section thereof. The sliding block 2 further comprises at the central portion of the bottom thereof a protruded portion 21 extending slightly outwardly. A clamping block 22 is disposed by the outer side of the long side of the sliding block 2 in such a manner that it is positioned correspondingly to the protruded portion 21 and that there is an appropriate clearance between the clamping block 22 and the protruded portion 21. The length of two short circuit metal pieces 23 is about equal to the combined length of two adjacent depressions 13. Both ends of the short circuit metal piece 23 extend outwardly toward both sides of the sliding block 2. Each of the two short circuit metal pieces 23 is disposed by the side of the sliding block 2 in such a manner that its inner recessed portion is fastened to the sliding block 2 by means of the protruded portion 21 and the clamping block 22. The protruded ends of the short circuit metal piece 23 make contact with the contact surface 151 of the contact metal piece 15 when the sliding block 2 moves in the rectangular slot 12. In addition, the protruded ends of the short circuit metal piece 23 pass through the wall 131 in view of the fact that the sliding block 2 comprises the recessed space permitting the protruded ends to compress inwardly. The protruded ends can resume their initial state by virtue of the elasticity of the short circuit metal piece 23. The sliding block 2 further comprises a protruded block 24 disposed at the upper edge of the top surface thereof. The protruded block 24 is intended for use in moving the sliding block 2 by the user.

The base 1 is provided respectively at both ends of the top surface thereof with a hole 16 having therein an obstructing surface 161 while the cover 3 is composed of hooks 31 and 32 located respectively at the bottom and the top surfaces thereof. In the process of assembling the preferred embodiment of the present invention, the hook 31 is inserted into the hole 16 in such a way that it can not be retreated in view of the impediment by the obstructing surface 161. The hook 32 is used to permit the cover 3 to be locked in with the wall 4 of the switch box.

Figure 2:
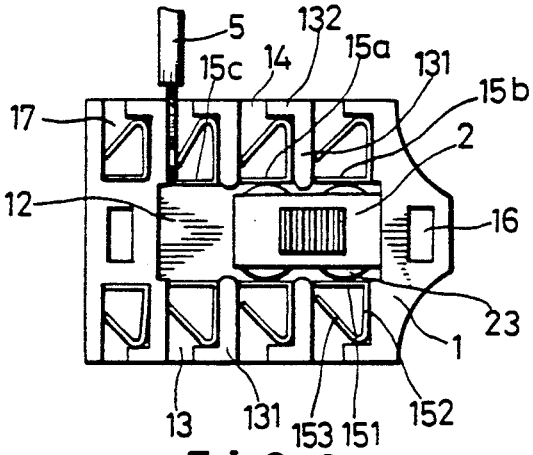
FIG. 2 shows a top view (excluding the cover) of the preferred embodiment of the present invention.
Figure 3:
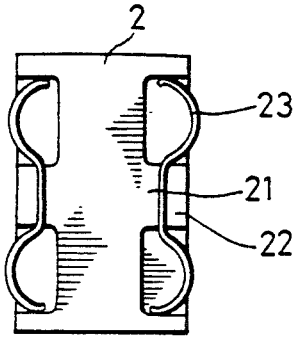
FIG. 3 shows a bottom view of the sliding block according to the present invention.
Figure 5:
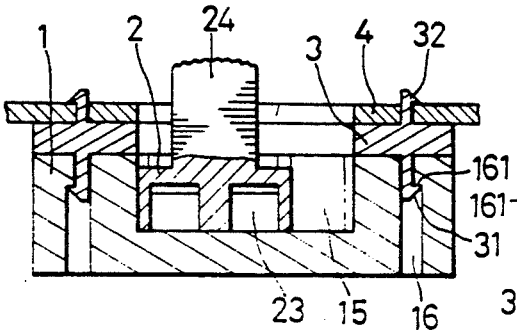
FIG. 5 shows a sectional view of the preferred embodiment of the present invention being arranged in a switching box.
Figure 4:
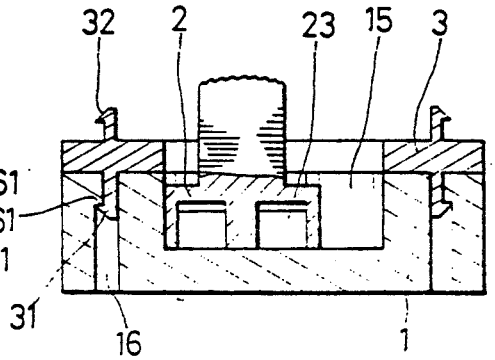
FIG. 4 shows a sectional view of the preferred embodiment of the present invention.

The middle contact metal piece **15*a* and the right contact metal piece 15*b* develop a short circuit to communicate each other by means of a short circuit metal piece 21 when the sliding block 2 is located in the right side of the rectangular slot 12, as shown in FIG. 2. As soon as the sliding block 2 is moved to the left side of the rectangular slot 12, the middle contact metal piece 15*a* and the left contact metal piece 15*c* develop a short circuit to communicate with each other by means of a short circuit metal piece 21. Therefore, the function of circuit switching can be carried out by moving the sliding block 2**.

In the process of arranging the preferred embodiment of the present invention in an electrical appliance, the stripped guide wire 5 is inserted into the insertion slot 14. The fastening portion 153 of the contact metal piece 15 is bent inwardly to form upper and lower portions so as to facilitate a secure clamping of the guide wire 5 by the contact metal piece 15.

Furthermore, the base 1 comprises at both sides thereof a slot 17, which is similar in shape to the depression 13 and is not connected with the rectangular slot 12, and a contact metal piece 15 for holding securely the common contact end.

What I claim is:

1. An electrical switch comprising:

(a) a base having two end surfaces, two lateral surfaces, a top surface, a bottom surface, and a rectangular slot located at a central portion of said base and extending into said top surface, said rectangular slot including two long and two short sides, and three depressions arranged in a side-by-side manner and extending laterally from each of said two long sides of said rectangular slot toward said lateral surfaces of said base, said depressions being deeper than said rectangular slot and in communication with said rectangular slot at upper sections of the depressions, and further mutually separated by partition walls connecting respectively with said lateral surfaces of the switch, and on a lateral side of each depression a guide wire insertion slot extending through a respective lateral surface of said base;

(b) a sliding block disposed in said rectangular slot and including two lateral sides and two end sides, a top surface and a bottom surface extending between the lateral and end sides, and a recessed space in said bottom surface, said sliding block further comprising at a middle portion of the bottom of said sliding block a protruded portion extending downwardly towards said bottom surface and projecting in lateral directions towards said lateral sides of the block and said sliding block further including two clamping blocks disposed adjacent respective long sides of said sliding block and positioned such that there is a clearance between each said clamping block and said protruded portion;

(c) two short circuit metal pieces each including two end portions and a central portion therebetween, said short circuit metal pieces having a length approximately equal to a combined length of two adjacent depressions and having both end portions extending outwardly from both lateral sides of said sliding block, each of said short circuit metal pieces being disposed at the lateral sides of said sliding block such that the respective central portions are fastened to said sliding block by being mounted in said clearances between said protruded portion and said clamping block;

(d) contact metal pieces lodged in said depressions and equal in number and substantially in height to said depressions, said contact metal pieces each being of triangular construction and having contact surfaces facing said rectangular slot and extending into the rectangular slot to obstruct common passages shared by said rectangular slot and said depression, said contact metal pieces each further comprising a support portion which engages one of said partition walls between the depressions and a fastening portion located at one of said insertion slots and bent inwardly toward said rectangular slot; and (e) a cover member secured to the top surface of said base in order to cover the tops of said rectangular slot and said depressions.

2. (new) An electrical switch according to claim 1, wherein said contact metal piece comprises in said fastening portion thereof a horizontally extending cross slit, top and bottom sides of which are arranged to engage a guide wire.

3. (new) An electrical switch according to claim 1, wherein said base comprises, at both of said end surfaces, end slots which are similar in shape to said depressions but which are not in communication with said rectangular slot, said end slots comprising therein additional contact metal pieces.

4. An electrical switch according to claim 1, wherein said top surface of the base has two ends and said base is provided respectively at both ends of the top surface of the base with a hole having therein an obstructing surface; and wherein said cover includes two hooks arranged respectively at bottom and top surfaces of the cover for engaging said holes to secure the cover on the base.

* * * * *